US006082255A

United States Patent [19]

Gundal et al.

[11] Patent Number: 6,082,255

[45] Date of Patent: Jul. 4, 2000

[54] PRESS APPARATUS WITH DYNAMIC COUNTERBALANCE AND FEED MECHANISM

[75] Inventors: Peter H. Gundal, Centerville; Bruce R. MacDonald, Attleboro, both of Mass.

[73] Assignee: Sencorp Systems, Inc., Hyannis, Mass.

[21] Appl. No.: 09/114,080

[22] Filed: Jul. 13, 1998

[51] Int. Cl.[7] ..... B30B 1/10; B30B 15/30

[52] U.S. Cl. ..... 100/35; 83/13; 83/436.3; 83/615; 83/630; 100/215; 100/257; 100/286

[58] Field of Search ..... 100/35, 257, 215, 100/281, 285, 286; 83/13, 436.3, 437.1, 615, 630; 198/629; 414/750, 800

[56] References Cited

U.S. PATENT DOCUMENTS

| | | | |
|---|---|---|---|
| 3,240,851 | 3/1966 | Scalora . | |
| 4,156,387 | 5/1979 | Portmann | 100/257 |
| 4,301,723 | 11/1981 | Borzym . | |
| 4,313,358 | 2/1982 | Brown . | |
| 4,316,712 | 2/1982 | Medendorp . | |
| 4,318,325 | 3/1982 | Bareis et al. | 100/286 |
| 4,391,171 | 7/1983 | Wendt . | |
| 4,890,524 | 1/1990 | Brown et al. . | |
| 5,109,766 | 5/1992 | Ontrop et al. . | |
| 5,335,532 | 8/1994 | Mueller et al. . | |
| 5,409,368 | 4/1995 | Heiskell et al. . | |
| 5,467,706 | 11/1995 | Kato | 100/286 |
| 5,588,344 | 12/1996 | Chun | 83/13 |

FOREIGN PATENT DOCUMENTS

| | | |
|---|---|---|
| 600650 | 6/1960 | Canada . |
| 2 309 362 | 8/1974 | Germany . |
| 52-1675 | 1/1977 | Japan . |
| 1606346 | 11/1990 | U.S.S.R. . |

OTHER PUBLICATIONS

T–Series Technical Data, Brown Leesona Corp., no date.

Gloucester Thermoforming Systems Brochure, Gloucester Engineering Co., 1982.

Irwin Research & Development Inc. Information Sheet, no date.

Series 3200 SD Information Disclosure, DT Industries Sencorp, no date.

Series 4300 SD Information sheet, DT Industries Sencorp, no date.

*Primary Examiner*—Stephen F. Gerrity

*Attorney, Agent, or Firm*—Dickstein Shapiro Morin & Oshinsky LLP

[57] ABSTRACT

A form, loop and trim system is provided with a toggle mechanism for dynamic counterbalancing. The system operates at high speed with reduced vibration. The system may be conveniently adjusted to handle products of different sizes, shapes and materials. An improved feed apparatus for indexing a sheet of thermoformed articles is also disclosed.

16 Claims, 3 Drawing Sheets

PRESS APPARATUS WITH DYNAMIC COUNTERBALANCE AND FEED MECHANISM

BACKGROUND OF THE INVENTION

The present invention relates to a system for handling material of indefinite length, such as a plastic sheet with discrete articles thermoformed therein. More particularly, the invention relates to a form, loop and trim system for forming products, such as plastic cups and trays, from a continuously advancing sheet.

In the prior art, plastic cups, trays and other articles are thermoformed into a continuous sheet of plastic. The plastic sheet is then looped and fed into a trim press apparatus. Brackets may be provided, if desired, to guide the sheet as it loops into the press apparatus. The press apparatus has a reciprocating trim die that severs or punches the articles from the sheet.

Prior art trim presses and other press apparatuses are shown in U.S. Pat. No. 5,409,368 (Heiskell et al.), U.S. Pat. No. 4,890,524 (Brown et al.), U.S. Pat. No. 4,391,171 (Wendt), U.S. Pat. No. 4,313,358 (Brown), and U.S. Pat. No. 3,240,851 (Scalora).

There is a need in the art for a trim press apparatus that operates reliably and efficiently at high speeds and with reduced vibration.

There is also a need in the art for a trim press apparatus that can be conveniently adjusted to handle products of different sizes, shapes, thicknesses and materials.

SUMMARY OF THE INVENTION

The disadvantages of the prior art press apparatuses are overcome to a great extent by using a toggle mechanism to move a press member and a counterbalance member in opposite to-and-fro directions. Thus, according to one aspect of the present invention, a press apparatus is provided with (1) a press member for applying a force to a workpiece (such as a thermoformed plastic sheet), (2) a counterbalance member for dynamically counterbalancing the press member, and (3) a toggle mechanism for moving the press member and the counterbalance member in opposite directions.

In a preferred embodiment of the invention, the toggle mechanism is driven by a servo motor. The motor may be used to adjust the configuration of the toggle mechanism.

In another aspect of the invention, the motor is connected to the toggle mechanism by driving arms and a pivoting member. In a preferred embodiment, the positions of the arms and the pivoting member may be adjusted to optimize the leverage applied to the toggle mechanism. The leverage applied to the toggle mechanism determines the speed and power of the press member in its punching position.

In another aspect of the invention, the press member and the counterbalance member are slidably supported for horizontal motion only. To reduce vibration, the counterbalance member preferably does not move vertically or rotationally.

In a preferred embodiment, the horizontal position of the toggle mechanism may be adjustable. Such adjustability facilitates use of the apparatus with sheets and articles of different sizes, shapes, thicknesses and materials.

In a preferred embodiment, the toggle mechanism is formed of two sets of pivotally connected link arms and pivot members. In the punch position, the link arms and the pivot members may be nearly aligned with each other. In the retracted position, the link arms and the pivot members fold into the shape of a sideways "S." The opposite ends of the link arms are pivotally connected to the press member and the counterbalance member.

In another aspect of the invention, a connection device is provided for driving the toggle mechanism. The connection device may have multiple openings for receiving a pin in different locations to change the stroke characteristics of the press apparatus.

An object of the invention is to facilitate adjustment of the stroke characteristics (length, start position, and shut height) of a press member in a form, loop and trim system.

Another object of the invention is to provide an improved high speed system for handling thermoformed plastic articles. In a preferred embodiment, the system can be quickly adjusted to handle plastic parts of different depths.

Another object of the invention is to provide an improved apparatus for cyclically feeding or indexing a thermoformed sheet into a trim press apparatus.

In a preferred embodiment, the feed apparatus has a reciprocating pushing device (such as a finger) for contacting and locating one side of the sheet, and a rotating device (such as opposed wheels) for subsequently engaging both sides of the sheet.

The invention may also be provided with a dwell mechanism for reciprocating the sheet horizontally as it is indexed into the press apparatus. In a preferred embodiment, the dwell mechanism has a cam and linked cam followers. A sprocket is used to adjust the stroke length of the sheet relative to the stroke length of the press member. The sprocket may be operatively connected to the press member by a toothed rack. The dwell apparatus causes the sheet to move quickly near the punch position and more slowly near the retracted position.

Another object of the invention is to provide a system for indexing a sheet into a trim press apparatus at high speed without damaging the sheet.

Another object of the invention is to provide a high speed apparatus that accurately and reliably indexes a thermoformed sheet into a trim press apparatus.

Another object of the invention is to provide a high speed system for moving a sheet into a trim press apparatus in such a way as to provide clearance for articles formed in the sheet.

Another object of the invention is to provide design flexibility so that a high speed trim press apparatus can be quickly and easily adjusted to handle products of different sizes, shapes, thicknesses and materials.

In a preferred embodiment, certain operating characteristics, such as the press stroke frequency, plastic sheet stroke length, and plastic sheet stroke start and stop positions, may be adjusted without interrupting the pressing operation (that is, without discontinuing the production of plastic articles). Thus, another object of the invention is to limit or eliminate the downtime that is needed to adjust the apparatus to switch from one thermoformed product to another.

These and other objects, features and advantages of the invention will become apparent from the following detailed description of preferred embodiments of the invention.

DETAILED DESCRIPTION OF PREFERRED EMBODIMENTS

Figure 1:
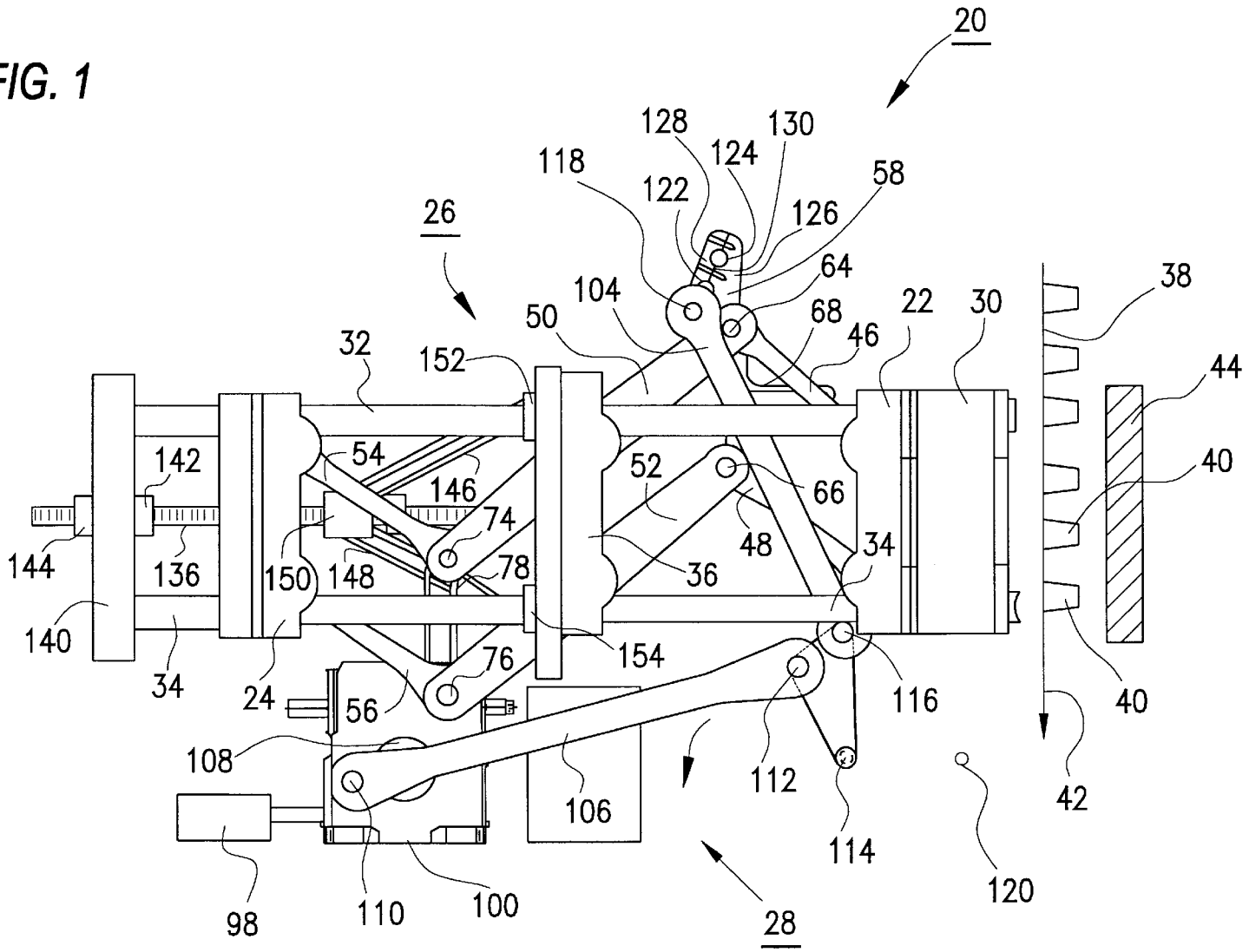
FIG. 1 is a side view of a reciprocating press apparatus constructed in accordance with a preferred embodiment of the invention.

Referring now to the drawings, where like reference numerals designate like elements, there is shown in FIG. 1 a reciprocating press apparatus 20 constructed in accordance with the present invention. The press apparatus 20 has a press member 22, a counterbalance member 24, a toggle mechanism 26, and a drive mechanism 28. The press member 22 carries a trim die 30. The press member 22 and the counterbalance member 24 are slidably supported on guides 32, 34. The toggle mechanism 26 moves the press member 22 and the counterbalance member 24 in opposite to-and-fro directions. The toggle mechanism 26 is secured to the guides 32, 34 by a base member 36. The drive mechanism 28 drives the toggle mechanism 26.

In operation, a plastic sheet 38 with articles 40 formed therein is indexed downwardly (in the direction of arrow 42) into a punch position between the trim die 30 and a stationary die 44. The sheet 38 is pressed between the trim die 30 and the stationary die 44, causing the articles 40 to be severed from the sheet 38. The articles 40 may be, for example, plastic cups or trays. The articles 40 may be formed on the sheet 38 in multiple rows and columns.

In a preferred embodiment of the invention, the trim die 30 may be reciprocated at a frequency of from twenty (20) to one hundred fifty (150) or more press strokes per minute.

The press member 22 and the trim die 30 have four openings (not shown) for slidably receiving the illustrated guides 32, 34 and two other, identical guides (not shown). The other guides are hidden from view in FIG. 1. The illustrated guides 32, 34 are located on the front side of the press apparatus 20. The other, identical guides are symmetrically located on the back side of the press apparatus 20. The guides 32, 34 and the openings may be cylindrical, and a suitable lubricant may be used. The press member 22 slides on the guides 32, 34 toward and away from the stationary die 44.

The counterbalance member 24 has four openings (not shown) matching the openings of the press member 22. The guides 32, 24 (only two of which are shown) extend through the four openings in the counterbalance member 24. The counterbalance member 24 slides on the guides 32, 34 toward and away from the press member 22.

The weight of the counterbalance member 24 may be approximately the same as the combined weight of the press member 22 and the trim die 30. The weight of the counterbalance member 24 may be adjustable to match the weight of the press member 22 and the trim die 30. In a preferred embodiment, for ideal dynamic counterbalancing, the frictional sliding forces applied to the counterbalance member 24 are the same as those acting on the press member 22 and the trim die 30.

Figure 2:
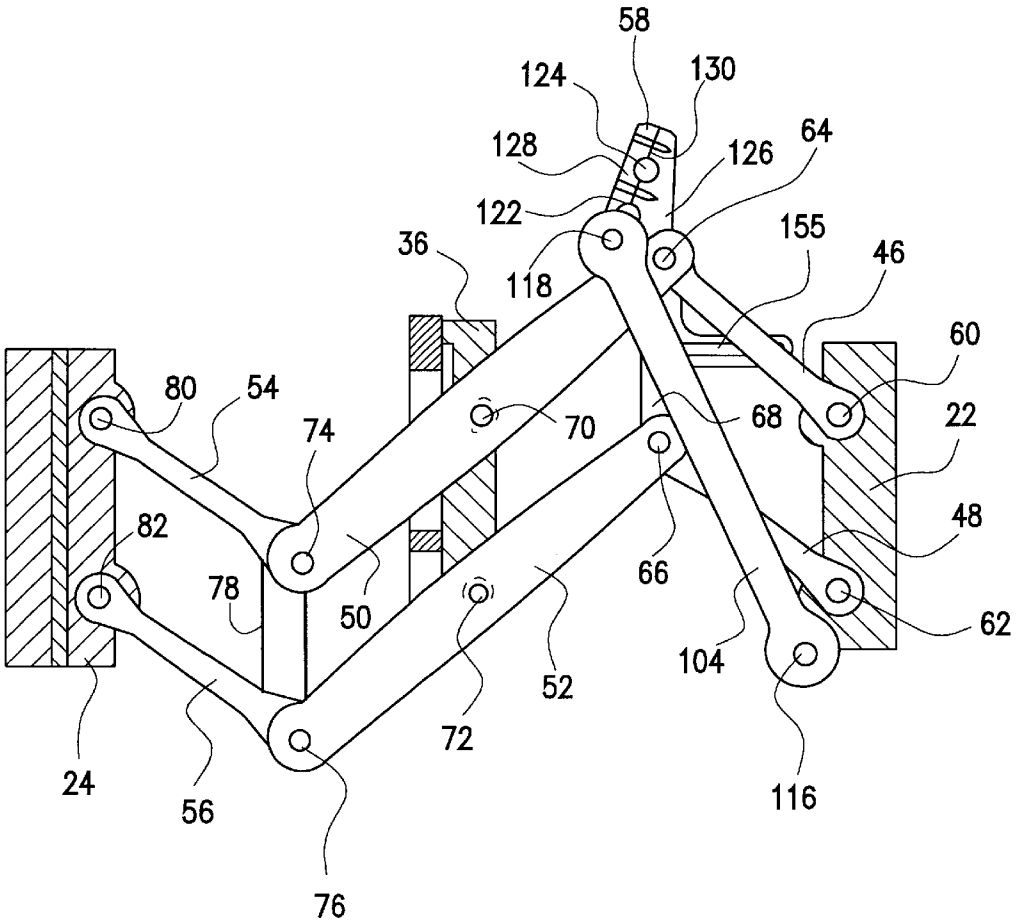
FIG. 2 shows the press member, the counterbalance member, the toggle mechanism, and the first driving arm of the press apparatus of FIG. 1.

The toggle mechanism 26 has first parallel link arms 46, 48, parallel pivot arms 50, 52, second parallel link arms 54, 56, and a connection device 58. The first link arms 46, 48 are pivoted to the press member 22 by first pivot pins 60, 62 (FIG. 2). The pivot arms 50, 52 are pivoted to the first link arms 46, 48 by second pivot pins 64, 66. The second pivot pins 64, 66 are vertically linked by a first brace arm 68.

The pivot arms 50, 52 are centrally pivoted to the base member 36 by third pivot pins 70, 72. The second link arms 54, 56 are pivoted to the pivot arms 50, 52 by fourth pivot pins 74, 76. The fourth pivot pins 74, 76 are vertically linked by a second brace arm 78. The second link arms 54, 56 are pivoted to the counterbalance member 24 by fifth pivot pins 80, 82.

The connection device 58 is integrally connected to the top pivot arm 50. The connection device 58 pivotally connects the toggle mechanism 26 to the drive mechanism 28. The structure of the connection device 58 is described in more detail below.

In operation, the connection device 58 is reciprocated up and down by the drive mechanism 28. As the connection device 58 is moved up and down, the press member 22 is moved away from and toward the stationary die 44. FIGS. 1 and 2 show the press member 22 in the retracted position (the press member 22 is moved away from the stationary die 44). In the punch position, the press member 22 is closest to the stationary die 44. In the punch position, the link arms 46, 48, 54, 56 and the pivot arms 50, 52 are nearly aligned with each other.

In a preferred embodiment, the toggle mechanism 26 is symmetrically constructed about a horizontal central axis. Thus, a second set of identical link arms and pivot arms are hidden from view in FIGS. 1 and 2 behind the illustrated link arms 46, 48, 54, 56 and pivot arms 50, 52. The second set of link arms and pivot arms are pivotally connected together and pivotally connected to the press member 22, the base member 36, and the counterbalance member 24 by pivot pins in the same manner as the illustrated set of link arms 46, 48, 54, 56 and pivot arms 50, 52.

The drive mechanism 28 has a servo motor 98 (FIG. 1), a gear box 100, a pivot arm 102, a first driving arm 104, and a second driving arm 106. The gear box 100 has a crank 108. The motor 98 drives the gear box 100 to rotate the crank 108. The second driving arm 106 is pivotally connected to the crank 108 and the pivot arm 102 by first and second drive pins 110, 112. The pivot arm 102 is rotatable to-and-fro about an axis 114. The first driving arm 104 is pivotally connected to the pivot arm 102 and the connection device 58 by third and fourth drive pins 116, 118.

In operation, the crank 108 is rotated by the motor 98. As the crank 108 is rotated, the second driving arm 106 rotates the pivot arm 102 to-and-fro, causing the first driving arm 104 to move up and down. The drive mechanism 28 is shown in FIG. 1 in the retracted position. As the drive mechanism 28 moves from the retracted position to the punch position, the pivot arm 102 is rotated clockwise (as viewed in FIG. 1) through an arc of about sixty two degrees (62°). In the punch position, the third drive pin 116 (connecting the first driving arm 104 to the pivot arm 102) is in the vicinity of point 120.

The leverage and other operating characteristics of the drive mechanism 28 may be adjusted and optimized by (1) selectively locating the pivot positions of the driving arms 104, 106 on the pivot arm 102, (2) selecting the spacing between the second and third drive pins 112, 116, (3) selecting the radial spacing between the second and third drive pins 112, 116 and the wheel axis 114, and (4) selecting the radial length of the crank 108.

A driving arm identical to the first driving arm 104 is hidden from view in FIGS. 1 and 2. The unillustrated driving arm is pivotally connected to the back side of the pivot arm 102 by the third drive pin 116. The unillustrated driving arm drives the second set of link arms and pivot pins in symmetry with the illustrated first driving arm 104.

The illustrated connection device 58 has first, second and third openings 122, 124 for selectively receiving the fourth drive pin 118. FIG. 1 shows the fourth drive pin 118 located in the first opening. The connection device 58 has a main piece 126 and a detachable piece 128. The interface 130 between the two pieces 128, 126 intersects the three openings 118, 122, 124. The detachable piece 128 is removably connected to the main piece 126 by suitable screws or the like.

The connection device 58 may be customized for particular operations. In other words, the openings 122, 124 need not be equidistant from each other. Likewise, the alignment of the openings 122, 124 may be changed to provide desired stroke characteristics. Moreover, the invention is not limited to the use of three openings in the connection device 58. One, two or more openings 122, 124 may be used, for example.

The stroke characteristics of the press member 22 may be changed by moving the fourth drive pin 118 from the first opening to one of the second and third openings 122, 124. In operation, to make the desired change, the detachable piece 128 is removed from the main piece 126, and then the servo motor 98 is advanced incrementally until the fourth drive pin 118 fits into the desired one of the second and third openings 122, 124. The removed piece 128 is then reattached to the main piece 126 and pressing operations are resumed. The stroke adjustment process may be repeated to move the fourth drive pin 118 to yet another one of the three openings 122, 124.

The base member 36 has four openings for slidably receiving the four guides 32, 34 (only two which can be seen in FIG. 1). The openings (not illustrated) spatially correspond to the respective openings through the press member 22 and the counterbalance member 24. The position of the base member 36 with respect to the guides 32, 34 (and hence the position of the press member 22 with respect to the stationary die 44) may be adjusted by sliding the base member 36 horizontally along the guides 32, 34.

The press apparatus 20 has a position adjusting device for changing the position of the base member 36. The position adjusting device has a threaded bar 136. The bar 136 is positioned relative to the guides 32, 34 by a securing assembly. The securing assembly has a fixed platen 140 rigidly connected to the guides 32, 34. The threaded bar 136 is rigidly connected to the fixed platen 140 by suitable nuts 142, 144 or the like. The bar 136 extends through a central opening (not illustrated) in the counterbalance member 24.

The threaded bar 136 is connected to the base member 36 by struts 146, 148. The horizontal position of the struts 146, 148 with respect to the threaded bar 136 may be adjusted by a suitable threaded nut 150 or the like. The struts 146, 148 hold the base member 36 fixed in the desired position during pressing operations. The distance between the base member 36 and the stationary die 44 may be changed by rotating the threaded bar 136. Complementary clamps 152, 154 may be used to ensure that the base member 36 remains fixed precisely in the desired position during pressing operations.

A link 155 is provided for connection to an eject mechanism (not shown). The apparatus 20 may be used without the eject mechanism. The eject mechanism is an optional feature. If desired, however, the eject mechanism may be used to aid in the final ejection of parts from the apparatus 20. In operation, a fraction of a second after the parts 40 are cut out of the sheet 38, an oscillator box (not shown) ejects the trimmed parts 40 horizontally away from the sheet 38 a distance of about one to eight inches. The oscillator box may be connected to the link 155 by other small linkages (not shown). A horizontal slot in the link 155 may be used for linkage to a vertically constrained cam follower (not shown).

Figure 3:
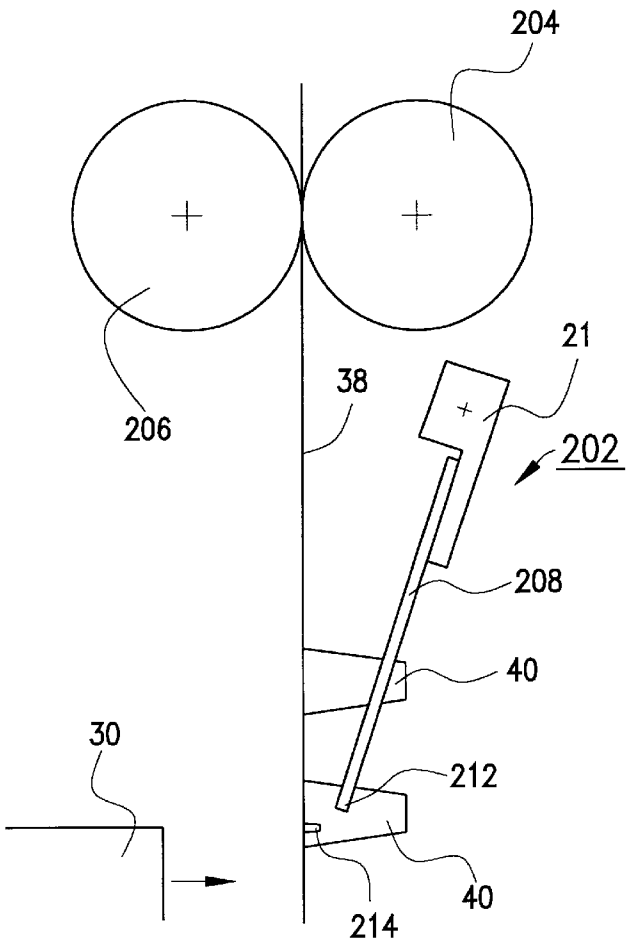
FIG. 3 is a side view of an indexing mechanism for the press apparatus of FIG. 1.

Referring now to FIG. 3, the press apparatus 20 has an indexing mechanism for advancing sections of the plastic sheet 38 into the punch position (between the trim die 30 and the stationary die 44). The indexing mechanism has a pushing device 202 for gently contacting the sheet 38. The indexing mechanism also has rollers 204, 206 for engaging the opposite sides of the sheet 38. The rollers 204, 206 move the sheet 38 down into the desired punch position.

The pushing device 202 has a finger 208 and a control device 210. The control device 210 causes the end 212 of the finger 208 to rotate and move down into contact with a thermoformed lug or projection 214 to gently move the sheet 38 into a desired start location. The force of the finger 208 should be sufficiently gentle such that the end 212 does not pierce the sheet 38 during high speed operations. In the start location, a group of plastic articles 40 is located a predetermined distance above the punch position.

When the sheet 38 is at the start position, the rollers 204, 206 are brought into engagement with the sides of the sheet 38. One of the rollers 204 may be driven by the motor 98. The other roller 206 may be moved horizontally toward and away from the driven roller 204 by a suitable air cylinder (not shown). The rollers 204, 206 may be formed of any suitable material, including metal and plastic materials. In a preferred embodiment, the driven roller 204 may have a rubber surface for increased friction.

The rollers 204, 206 index the sheet 38 rapidly downward from the start position to the punch position. Then, the rollers 204, 206 disengage the sheet 38 and the cycle is repeated in synchronism with the reciprocating operation of the press member 22.

The linear indexing speed of the sheet 38 is proportional to the diameter of the driven roller 204 and the operating speed of the motor 98. Thus, the indexing speed may be controlled by selecting the diameter of the driven roller 204 and/or by adjusting the speed of the motor 98.

Preferably, the indexing mechanism is symmetrical with respect to the horizontal axis of the press apparatus 20. A second pushing device identical to the illustrated pushing device 202 may be provided to locate a lug or projection on the back edge (not illustrated) of the sheet 38. Likewise, a second set of rollers identical to the illustrated rollers 204, 206 may be provided to engage the back edge of the sheet 38. The second pushing device and the second set of rollers are hidden from view in FIG. 3.

Preferably, the pushing device 202 and the rollers 204, 206 are controlled such that the sheet 38 moves smoothly into the press apparatus 20. A smooth transition may be provided by operating the pushing device 202 at a non-constant speed during its downward stroke.

Although the thermoformed articles 40 are shown in FIGS. 1 and 3 facing toward the stationary die 44, the invention may also be practiced, if desired, with the articles 40 facing away from the stationary die 44. The invention should not be limited to the preferred embodiments shown and described herein.

Figure 4:
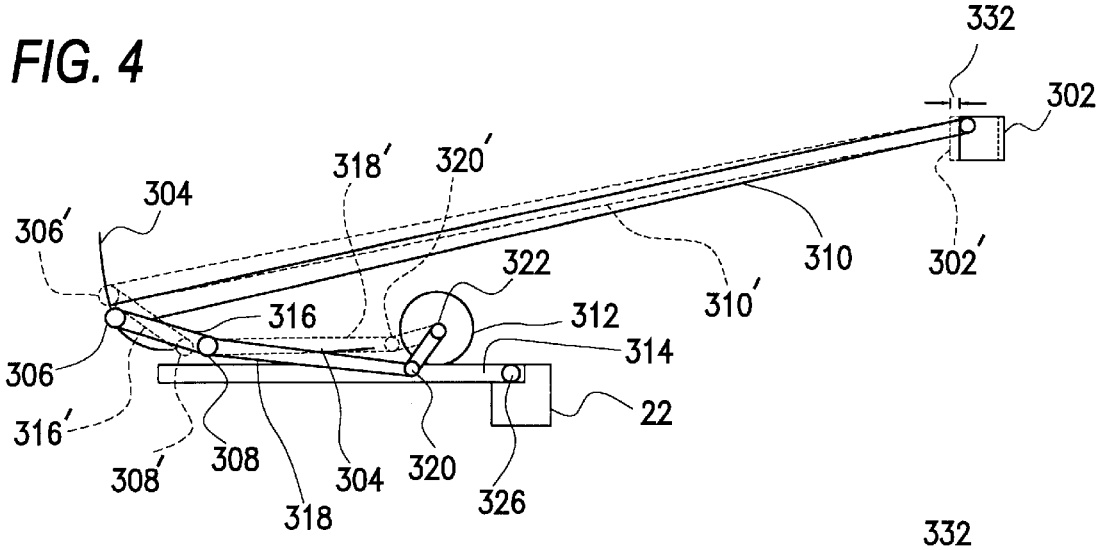
FIGS. 4–6 are side views showing a control system for the indexing mechanism of FIG. 3.
Figure 5:
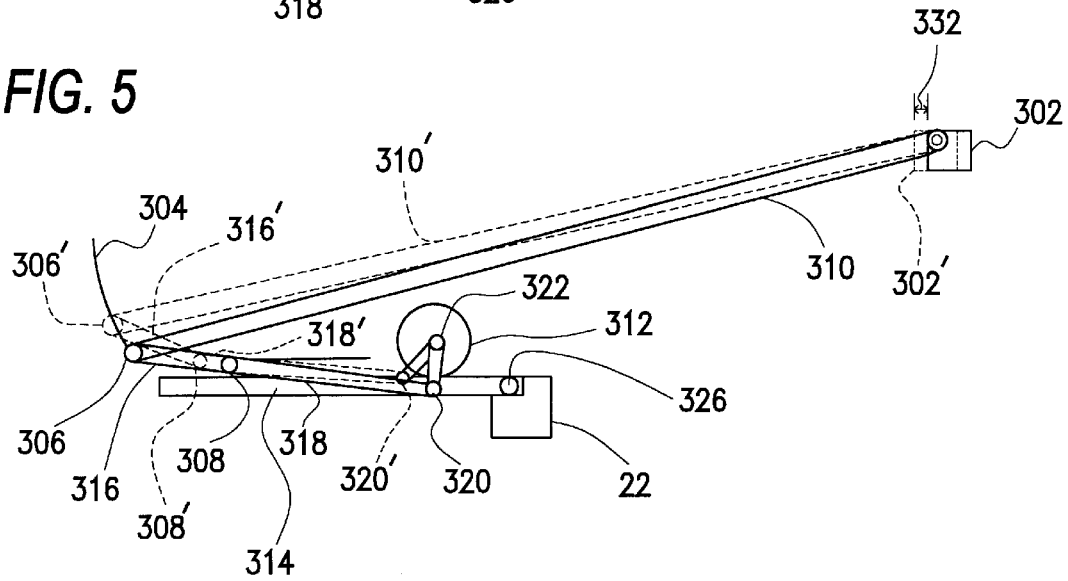
Figure 6:
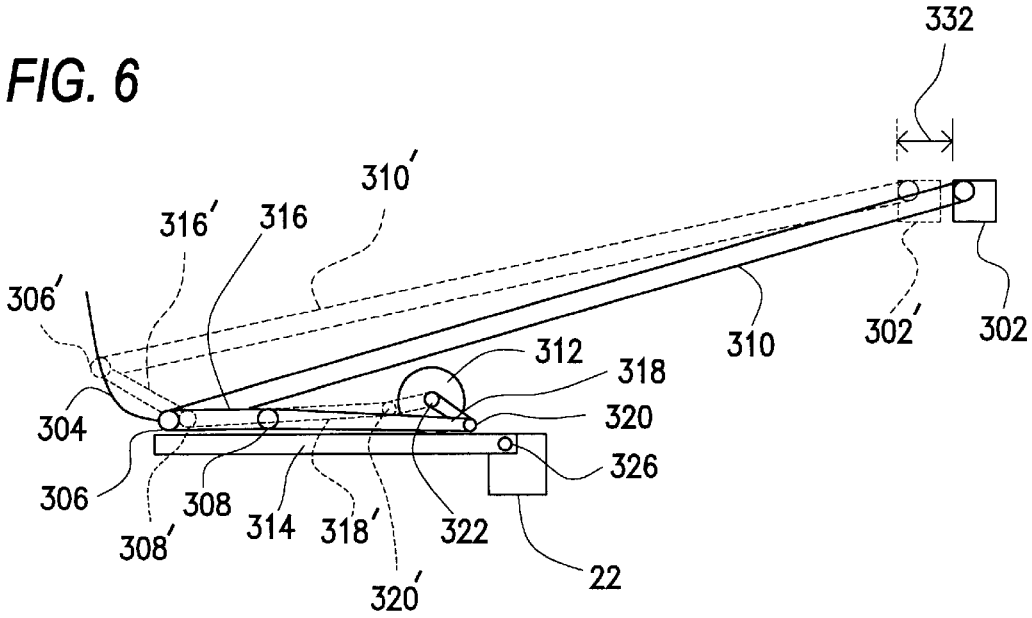

Referring now to FIGS. 4–6, the press apparatus 20 may have a control apparatus for controlling the horizontal position of the plastic sheet 38 immediately above the punch position (that is, upstream from the stationary die 44). In the punch position, the molded articles 40 fit into respective openings (not shown) in the stationary die 44. Consequently, the sheet 38 has a horizontal component of movement during the vertical indexing operation performed by the indexing mechanism shown in FIG. 3.

The control apparatus has a car 302 that moves the upper portion of the sheet 38 horizontally to accommodate the movement of the articles 40 into the openings in the stationary die 44. The control apparatus also has a cam 304, first and second cam followers 306, 308, a control arm 310, a sprocket 312, and a toothed rack 314. The cam followers 306, 308 follow the curved path of the cam 304. The control arm 310 connects the car 302 to the first cam follower 306.

The second cam follower 308 is pivoted to the first cam follower 306 by a first control arm 316. The second cam follower 308 is connected to the sprocket 312 by a second control arm 318. The second control arm 318 is eccentrically attached to the sprocket 312 by a control pin 320. The sprocket 312 rotates about a fixed axis 322. The sprocket 312 meshes with and is rotated by the top toothed surface of the rack 314. For clarity of illustration, the teeth of the sprocket 312 and the rack 314 are not shown in the drawings.

The front end of the rack 314 is rigidly attached to the moving press member 22. The front end may be connected to the press member 22 by a press member pin 326. Thus, the rack 314 is moved horizontally to-and-fro by the reciprocating movement of the press member 22. As the press member 22 is moved from the retracted position to the punch position (from left to right in FIGS. 1 and 2), the rack 314 moves in the same direction (from left to right in FIGS. 4–6), and the sprocket 312 is rotated counterclockwise. When the sprocket 312 rotates counterclockwise, the control arms 316, 318, the control driving arm 310, and the car 302 (guides the upper part of the sheet 38) all move from left to right (viewed in FIGS. 4–6).

In FIGS. 4–6, the elements of the control apparatus in the punch position are shown in solid lines. The elements of the control apparatus in the retracted position are shown in dashed lines with primed reference numerals.

The upper portion of the sheet 38 is moved by the car 302 in the same horizontal direction as the press member 22. As the press member 22 moves to the retracted position (to make room for another set of articles 40 to be punched), the car 302 moves from a first position to a second position. As the press member 22 moves from the retracted position to the punch position (to press the articles 40 out of the sheet 38), the car 302 moves back from the second position to the first position.

The distance 332 traveled by the car 302 between the first and second positions may be adjusted by changing the angular start position of the eccentric connection pin 320 as discussed in more detail below in connection with particular operational examples.

In FIG. 4, the press apparatus 20 is arranged such that the press member 22 has a press stroke of three inches (three inches from its retracted position to its punch position). In the punch position, the sheet 38 is pressed tightly between the trim die 30 and the stationary die 44. The toggle mechanism 26 is symmetrical with respect to the base member 36. Consequently, the stroke length of the counterbalance member 24 is always the same as that of the press member 22. Thus, in the FIG. 4 arrangement, the counterbalance member 24 travels three inches from the retracted position to the press position (from right to left in FIGS. 1 and 2).

The press member 22 and the counterbalance member 24 move horizontally only. They have no vertical component of motion. Thus, the movement of the counterbalance member 24 provides a dynamic counterbalance for the movement of the press member 22, and can be used to essentially eliminate vibration, regardless of the stroke length, regardless of the stroke start position, and regardless of the reciprocating frequency of the pressing operation.

In the FIG. 4 arrangement, when the press member 22 is in the punch position, the eccentric control pin 320 is located two hundred forty degrees from vertical (measured in the clockwise direction). As the press member 22 moves to the retracted position, the press member pin 326 moves from right to left three inches, and the eccentric control pin 320 rotates clockwise through an arc of about thirty eight degrees, causing the car 302 to move from right to left about one-quarter inch.

In the adjusted arrangement shown in FIG. 5, the stroke length for the press member 22 is still three inches. The punch position for the eccentric control pin 320, however, is changed to one hundred eighty seven degrees from vertical. In the FIG. 5 arrangement, as the press member 22 moves from the punch position to the retracted position, the sprocket 312 is rotated clockwise through an angle of thirty eight degrees, causing the car 302 to move from right to left about one and three-quarters inches.

In the FIG. 6 arrangement, the stroke length for the press member 22 is ten and one-half inches. The punch position for the eccentric control pin 320 is changed to one hundred twenty five degrees from vertical. As the press member 22 moves from the punch position to the retracted position, the sprocket 312 is rotated clockwise through an angle of about one hundred thirty four degrees, resulting in a car travel distance 332 of about six and one-half inches.

Set forth below is a table illustrating several ways in which the press apparatus 20 may be arranged or adjusted in terms of the stroke length of the press member 22 and the corresponding horizontal car travel 332. The table demonstrates that the invention provides design flexibility to handle sheets 38 of different materials and articles 40 of different sizes and shapes.

| Press Member Stroke (in.) | Punch Position | Sprocket Rotation | Car Travel (inches) |
|---|---|---|---|
| 3.0 | 214° | 38° | 0.262 |
| 3.0 | 187° | 38° | 1.736 |
| 10.5 | 184° | 134° | 1.70 |
| 10.5 | 125° | 134° | 6.50 |
| 4.5 | 214° | 57° | 0.262 |
| 4.5 | 177° | 57° | 2.55 |
| 7.5 | 190° | 95° | 1.51 |
| 7.5 | 157° | 95° | 4.25 |

An important feature of the control apparatus of FIGS. 4–6 is that it provides dwell for the car 302 at the retracted position. Near the retracted position, the first cam follower 306 moves in a nearly vertical direction, with very little horizontal motion. Near the punch position, the first cam follower 306 has a larger component of horizontal motion. The configuration of the cam 304, with a near vertical portion near the retracted position and a more horizontal portion near the punch position, provides improved control over the movement of the car 302. In particular, the car 302 moves quickly near the punch position, but dwells (moves more slowly) near the retracted position.

The invention should not be limited to the specific examples described herein. The above descriptions and the drawings are only illustrative of preferred embodiments which achieve features and advantages of the present invention. It is not intended that the present invention be limited thereto. Any modification of the invention which comes within the spirit and scope of the following claims is considered part of the present invention.

What is claimed as new and desired to be protected by Letters Patent of the United States is:

1. A press apparatus, comprising:

a press member for applying a force to a workpiece;

a counterbalance member for counterbalancing said press member;

a toggle mechanism for moving said press member and said counterbalance member in opposite directions;

a motor for driving said toggle mechanism, wherein said motor is a servo motor for adjustably controlling the position of said toggle mechanism; and a connecting mechanism for connecting said motor to said toggle mechanism, said connecting mechanism including a pivot arm and first and second driving arms, said second driving arm being located between said motor and said pivot arm, said first driving arm being located between said pivot arm and said toggle mechanism.

2. The press apparatus of claim 1, further comprising guides for slidably supporting said press member and said counterbalance member.

3. The press apparatus of claim 2, further comprising a base member for adjustably positioning said toggle mechanism.

4. The press apparatus of claim 3, wherein said base member is slidably supported by said guides.

5. The press apparatus of claim 4, further comprising means for adjusting the position of said base member with respect to said guides.

6. The press apparatus of claim 2, wherein said toggle mechanism includes a first link arm pivotally connected to said press member, a pivot member pivotally connected to said first link arm, and a second link arm pivotally connected to said pivot member, and wherein said second link arm is pivotally connected to said counterbalance member.

7. The press apparatus of claim 6, further comprising a base member for positioning said toggle mechanism and wherein said pivot member is centrally pivoted to said base member.

8. The press apparatus of claim 6, further comprising a driving arm for moving said first link arm and said pivot member, and a connection device for pivotally connecting said driving arm to said first link arm and said pivot member.

9. The press apparatus of claim 8, wherein said connection device is adjustable to adjust the movement of said press member and said counterbalance member.

10. The press apparatus of claim 9, wherein said connection device has spaced apart connection means for changing the position of said driving arm with respect to said pivot member.

11. A method of pressing articles from a continuous sheet, said method comprising the step of:

moving a press member toward and away from said sheet;

moving a counterbalance member toward and away from said press member to counterbalance said press member including the step of sliding said counterbalance member on a guide mechanism;

applying a reciprocating force to a toggle mechanism to move said press member and said counterbalance member in opposite directions;

using a servo motor to control the position of said toggle mechanism; and pivoting a pivot member with respect to a base member, and moving said base member with respect to said guide mechanism, wherein said pivot member is part of said toggle mechanism, and wherein said base member is slidably supported by said guide mechanism.

12. The method of claim 11, further comprising the step of adjusting the stroke length of said press member.

13. The method of claim 12, wherein said sheet is formed of plastic.

14. A form, loop and trim system for handling a plastic sheet, said system including:

a press apparatus;

an apparatus for cyclically feeding the sheet into said press apparatus, said press apparatus including a press member for applying a force to the sheet, a counterbalance member for counterbalancing said press member, a toggle mechanism for moving said press member and said counterbalance member in opposite directions, and a motor for driving said toggle mechanism; and a connecting mechanism for connecting said motor to said toggle mechanism, said connecting mechanism including a pivot arm and first and second driving arms, said second driving arm being located between said motor and said pivot arm.

15. The system of claim 14, further comprising a guide mechanism for slidably supporting said press member and said counterbalance member, and a base member for adjustably positioning said toggle mechanism.

16. The system of claim 15, wherein said toggle mechanism includes first link arms pivotally connected to said press member, pivot members pivotally connected to said first link arms, and second link arms pivotally connected to said pivot members, and wherein said second link arms are pivotally connected to said counterbalance member.

* * * * *

UNITED STATES PATENT AND TRADEMARK OFFICE
CERTIFICATE OF CORRECTION

PATENT NO. : 6,082,255

DATED : July 4, 2000

INVENTOR(S) : Peter Gundal et al.

It is certified that errors appear in the above-identified patent and that said Letters Patent is hereby corrected as shown below:

Delete Figure 1 and insert therefor the below-included Figure 1.

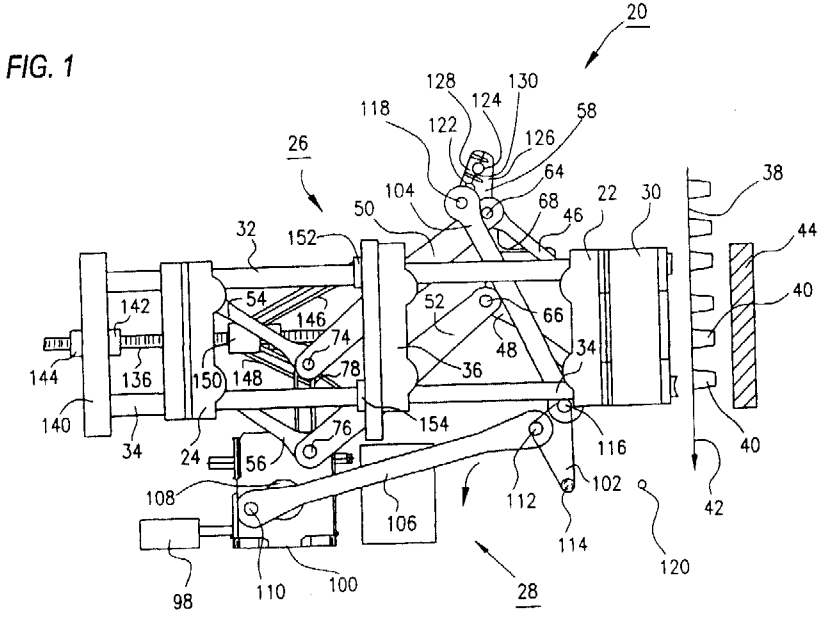

FIG. 1

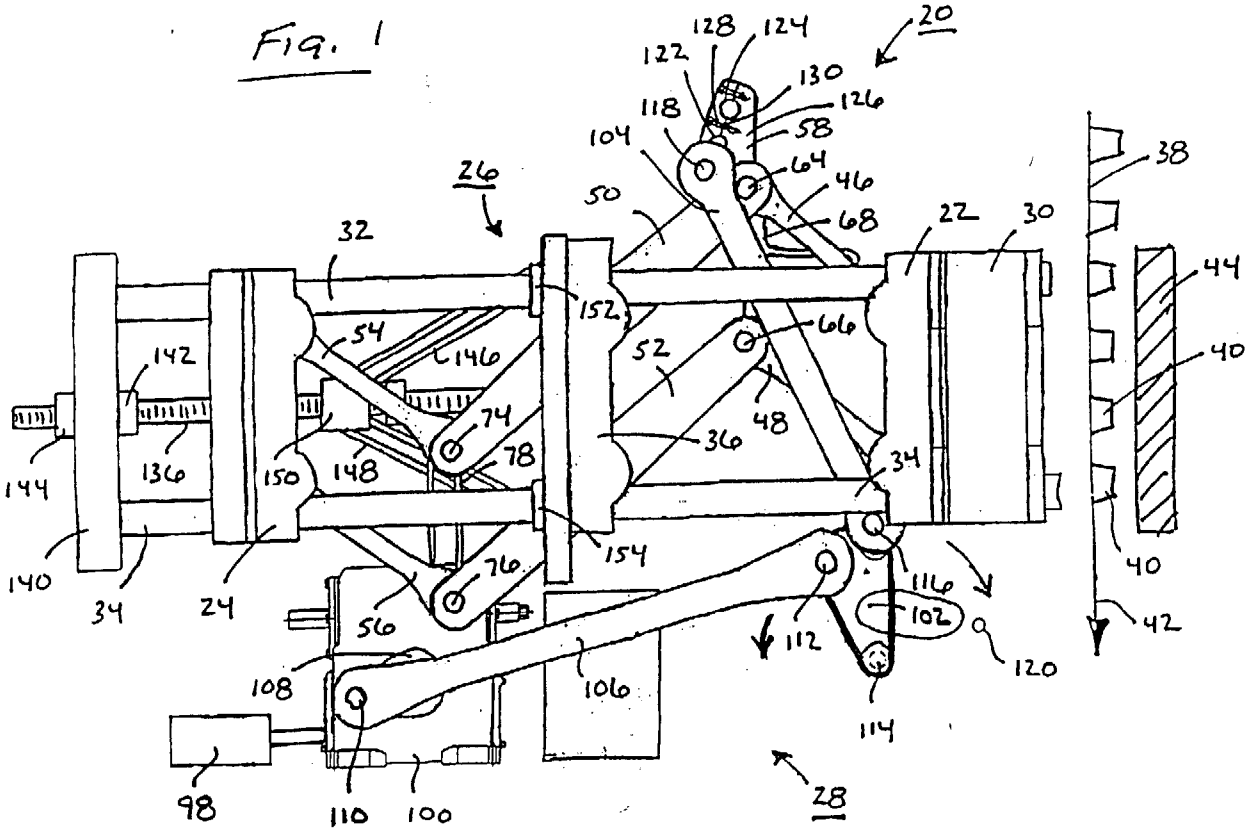

FIG. 1

Signed and Sealed this

Seventeenth Day of April, 2001

*Attest:*

Nicholas P. Godici

NICHOLAS P. GODICI

*Attesting Officer*

*Acting Director of the United States Patent and Trademark Office*